US005170944A

United States Patent [19]

Shirai

[11] Patent Number: 5,170,944

[45] Date of Patent: Dec. 15, 1992

[54] FAUCET APPARATUS WITH ULTRASONIC CONTROL DEVICE

[75] Inventor: Kenji Shirai, Aichi, Japan

[73] Assignee: Inax Corporation, Tokoname, Japan

[21] Appl. No.: 765,823

[22] Filed: Sep. 26, 1991

[30] Foreign Application Priority Data

Oct. 2, 1990 [JP] Japan ..... 2-104284[U]

[51] Int. Cl.[5] ..... E03C 1/05

[52] U.S. Cl. ..... 239/569; 239/588; 4/623; 251/129.04; 137/801; 367/198

[58] Field of Search ..... 239/200, 273, 282, 283, 239/525, 569, 588, 602; 4/623; 251/129.04; 137/801; 367/197-199

[56] References Cited

U.S. PATENT DOCUMENTS 2,347,330 4/1944 Noyes ..... 239/525
4,402,095 9/1983 Pepper ..... 4/623
4,735,357 4/1988 Gregory et al. ..... 4/623

FOREIGN PATENT DOCUMENTS 1609211 9/1971 Fed. Rep. of Germany .
2721217 11/1978 Fed. Rep. of Germany .
3338064 5/1984 Fed. Rep. of Germany .
0181736 10/1984 Japan ..... 367/199
0190743 10/1984 Japan ..... 367/199

*Primary Examiner*—Andres Kashnikow
*Assistant Examiner*—Karen B. Merritt
*Attorney, Agent, or Firm*—Kanesaka and Takeuchi

[57] ABSTRACT

A faucet apparatus includes an ultrasonic transmitter and an ultrasonic receiver provided at a predetermined distance away from each other through a water flow passage. An ultrasonic wave transmitted from the transmitter is propagated through the flow passage as a control signal for operation control of the faucet apparatus and is received with the receiver.

8 Claims, 2 Drawing Sheets

FAUCET APPARATUS WITH ULTRASONIC CONTROL DEVICE

BACKGROUND OF THE INVENTION

1. Field of the Invention

The present invention relates to a faucet apparatus.

2. Related Art

In a faucet apparatus, turning on of water, turning off of water, temperature adjustment and the like have been heretofore performed mechanically by manual operation of a handle, a lever and the like. Such a faucet apparatus in which a sensor portion and an operation portion are provided at a discharge port extending from a faucet body portion, and a detection signal from the sensor portion and an operation signal from the operation portion are transmitted to an operation control portion through a lead wire or a cable so as to control the operation of turning on of water and the like has been developed and used lately.

In case of a faucet apparatus of this sort, however, it is required to wire the lead wire or the cable so that it is invisible from the outside. Thus, there has been such an objection that the structure of the apparatus becomes complicated inevitably, and there has also been such a problem that the structure of the apparatus is restricted and the degree of freedom in design is limited because of the wiring of these lead wire and cable.

Moreover, there has been a fear that the function of the apparatus is deteriorated in this case due to disconnection of the lead wire or the cable, and the whole wiring portion has to be disassembled for repair in case of disconnection thereof, thus causing a problem of troublesome maintenance.

OBJECT AND SUMMARY OF THE INVENTION

It is an object of the present invention to provide a faucet apparatus having a simple apparatus construction.

It is another object of the present invention to provide a faucet apparatus in which maintenance is simplified.

According to a faucet apparatus of the present invention, an ultrasonic transmitter and a receiver are disposed on a water flow passage at a predetermined distance away from each other, and an ultrasonic wave transmitted from the transmitter is propagated through the flow passage as a control signal for operation control of the faucet apparatus and is received by the receiver.

In the faucet apparatus of the present invention, an ultrasonic wave is employed for the control signal for operation control of the faucet apparatus and a water flow passage is used as a transmission path of the control signal. Accordingly, it is possible to omit a lead wire or a cable as a transmission path of a control signal in a conventional apparatus.

As a result, even in case a sensor portion, an operation portion and the like are installed in a water flow passage such as a port discharge of the faucet apparatus, it is not required to adopt a wiring structure for concealing the lead wire or the cable. Thus, the apparatus structure may be simplified and the degree of freedom in designing the apparatus is improved significantly.

Further, in the case of the present invention, there is no fear of disconnection as having been experienced in the case of using a lead wire or a cable because a water flow passage is used as a transmission path of a control signal, and maintenance is simplified since only a trouble portion needs to be disassembled for repair.

The present invention takes an excellent effect when it is applied to a faucet apparatus having a configuration in which a hose extending from the faucet body is fitted with a shower head at an end thereof. In the case of this faucet apparatus, it is desirable that an operation portion is provided on the shower head so that discharge operation of water and the like when the shower is used may be operated. In this case, however, when a long lead wire or cable is adopted as a transmission path of a control signal, the long lead wire or cable has to be installed without deteriorating flexibility of the hose. Therefore, such problems are caused that the lead wire or the cable is easily disconnected due to deformation of the hose in addition to the difficulty in wiring thereof.

However, when the present invention is applied to such a faucet apparatus, that is, when an ultrasonic transmitter is provided on a shower head, an ultrasonic receiver is provided on the side of the faucet body portion and a control signal for operation control of the shower is transmitted by an ultrasonic wave from the transmitter to the receiver, it is not required to wire a lead wire or a cable on the hose. Therefore, it is possible to prevent such problems and to improve the reliability of the apparatus.

DESCRIPTION OF THE PREFERRED EMBODIMENTS

Figure 1:
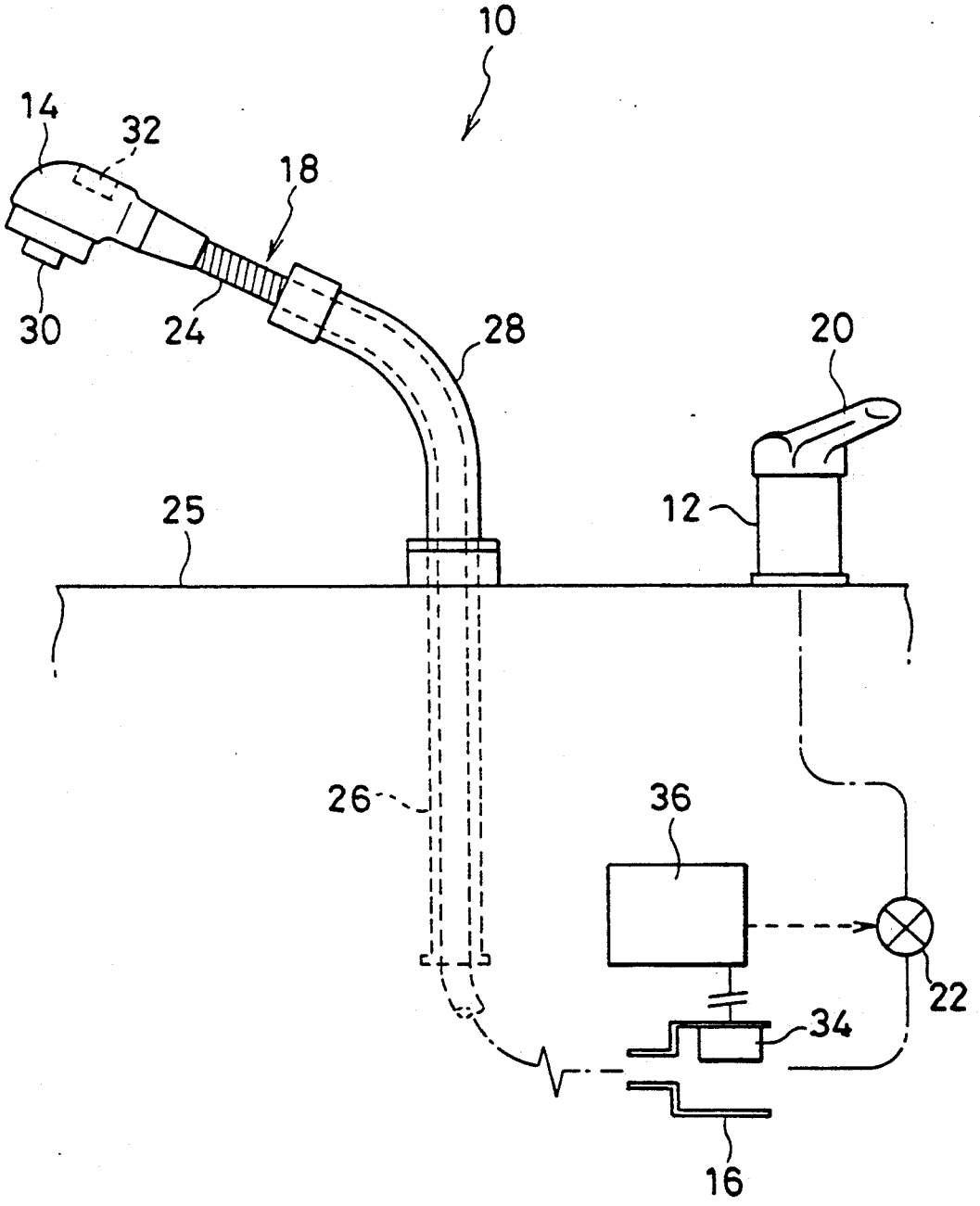
FIG. 1 is an explanatory view showing an embodiment of a faucet of the present invention.

In FIG. 1, a single lever type shampoo faucet 10 includes a mixing valve 12 having a manual operation lever 20, a shower head 14, a fixed piping 16 and a hose 18 for connecting them.

The manual operation lever 20 provided on the mixing valve 12 is for performing temperature control of water and turning on of water from the shower head 14 manually by turning it horizontally and vertically, and the mixing valve 12 feeds water adjusted to a desired temperature by means of turning operation of the lever 20 to the fixed piping 16.

An electromagnetic valve 22 is provided on the fixed piping 16, and mixed water fed from the mixing valve 12 to the fixed piping 16 is supplied to the hose 18 or stopped to be supplied to the hose 18 by opening and closing of the electromagnetic valve 22. That is to say, in the faucet 10 of the present embodiment, discharge of water from the shower head 14 is controlled manually by the lever 20 in a state that the electromagnetic valve 22 is opened, and, on the other hand, discharge of water from the shower head 14 is controlled by opening and closing of the electromagnetic valve 22 in a state that the mixing valve 12 is opened by the lever 20.

The hose 18 which leads water from the fixed piping 16 to the shower head 14 is made by attaching a metallic shape holder 24 having a bellows form on an outside surface of a hose body made of resin, and the hose 18 is made to run through a backup pipe 26 provided so as to be able to project from an upper surface of a cabinet 25 at a tip side thereof and a guide pipe 28 attached fixedly to the tip of the backup pipe 26 in a loose fit state. This hose 18 may be taken in and out relative to the guide pipe 28 freely.

Figure 2:
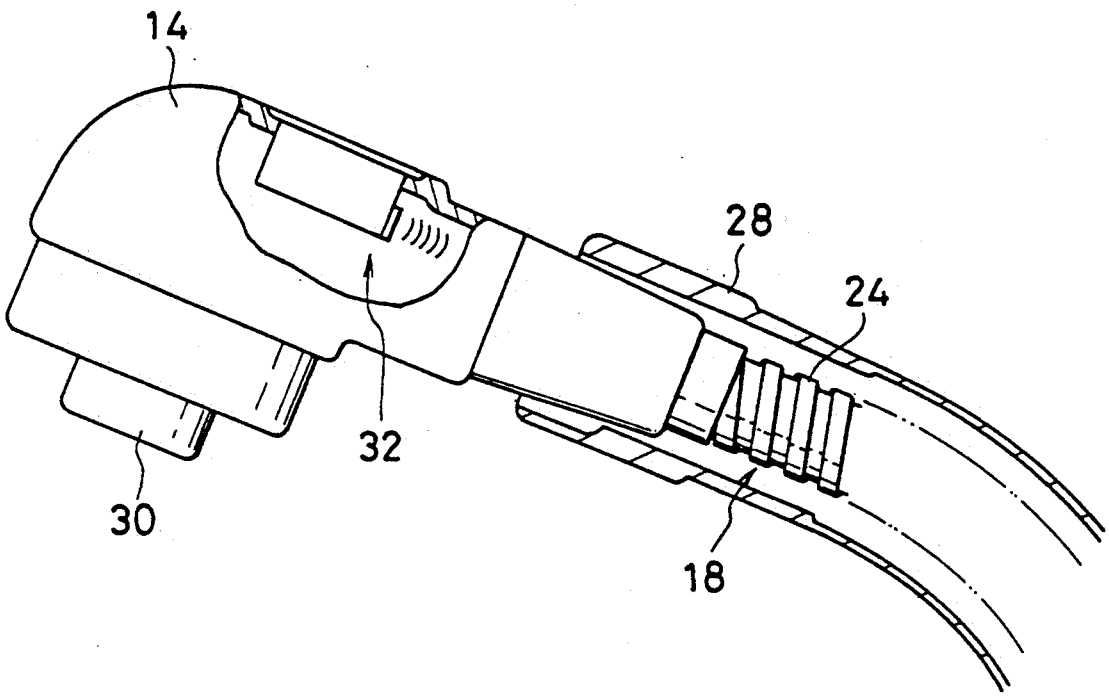
FIG. 2 is a sectional explanatory view showing by enlarging a principal part of the faucet.

An ultrasonic transmitter 32 is provided on the shower head 14 at a portion kept in a state always filled with water by means of a watertight mechanism for instance as shown in FIG. 2 in detail. On the other hand, an ultrasonic receiver 34 is provided on the fixed piping 16.

The ultrasonic transmitter 32 includes an operation portion provided with a switch which is operable from the outside, a transmission circuit portion which receives an operation signal of the switch and outputs an operation control signal and an ultrasonic wave transmitter which receives a signal from the transmission circuit portion and emits an ultrasonic wave. When the switch of the operation portion is operated, an actuation control signal having data contents corresponding to the switch is emitted from the ultrasonic wave transmitter toward the hose 18 side.

The ultrasonic receiver 34 includes an ultrasonic wave receiver which receives an ultrasonic wave emitted from the ultrasonic transmitter 32 and propagating through water and a receiving circuit portion thereof, and outputs a signal received at the receiving circuit portion to a controller 36. Then, the controller 36 applies driving signals to respective control object portions in accordance with data contents of the received signal.

Besides, in the present embodiment, a turning on of water/turning off of water switch is provided in the operation portion of the ultrasonic transmitter 32, and a turning on of water control signal or a turning off of water control signal is emitted as an ultrasonic wave from the ultrasonic wave transmitter by the operation of this switch. Further, the ultrasonic receiver 34 receives the ultrasonic wave with an ultrasonic wave receiver and applies the received signal to the controller 36, and the controller 36 controls opening and closing of the electromagnetic valve 22 in accordance with the received signal. In other words, when the faucet body 12 is opened, discharge of water from the shower head 14 is controlled.

As described above, in the faucet 10 of the present embodiment, it is possible to control discharge of water from the shower head 14 by operating an operation switch provided on the ultrasonic transmitter 32 of the shower head 14 when the mixing valve is kept open with the lever 20. Thus, there is an advantage that the state of discharge of water can be controlled easily within reach without stretching one's arm to the mixing valve 12 purposely.

Further, in the faucet 10 of the present invention, since the portion between the operation portion disposed on the shower head 14 and the controller 36 provided on the base end side of the hose 18 is constructed of an ultrasonic transmitter/receiver device, i.e. water in the hose 18 as an ultrasonic wave propagating medium, it is not required to use a lead wire or a cable as a signal transmission line. Accordingly, it is possible to construct the structure of the hose 18, or the whole shower faucet simply, and to prevent troubles caused by disconnection of the lead wire or the cable, thus improving reliability and making maintenance easier.

An embodiment of the present invention has been described in detail above, but the present invention is not limited thereto.

For example, only the operation of turning on of water/turning off of water has been controllable in the shower head 14 in the case of the previous example, but it is also possible to perform change-over control and the like for changing over discharge water quantity, water temperature or discharge water condition from a discharge opening 30 between spread discharge water and concentrated discharge water.

Figure 3:
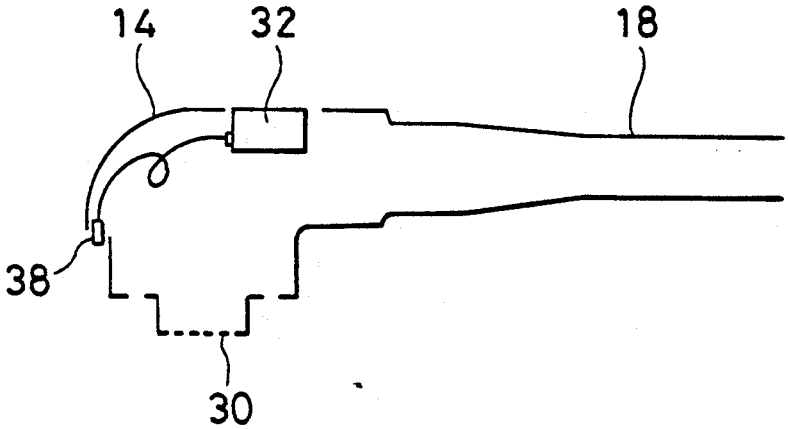
FIG. 3 is an explanatory view of a principal part showing another embodiment of the present invention.

Further, when a human body detection sensor 38 is provided on the shower head 14 so as to perform water discharge operation from the discharge port 30 automatically as shown in FIG. 3, it may also be arranged so that a detection signal of the sensor 38 is transmitted with an ultrasonic wave from the ultrasonic transmitter 32 to the ultrasonic receiver 34.

Other than the foregoing, the present invention may be constructed in configurations applied with various modifications based on the knowledge of those skilled in the art within a scope not departing from the gist thereof in such a manner that it is applicable, other than the faucet 10 described in the precedent, to an ordinary shower faucet in which a hose of the shower head extends directly from the faucet body, and an ordinary faucet apparatus in which a water discharge tube extends from the faucet body and the like.

I claim:

1. A faucet apparatus comprising:

a liquid passage having a receiving portion for receiving liquid and a discharge portion for discharging liquid, said liquid passage being filled with liquid at least between the receiving portion and the discharge portion, means for controlling flow of liquid passing through the liquid passage, said flow controlling means being provided in the liquid passage, a control unit for operating the flow controlling means, an ultrasonic transmitter for transmitting an ultrasonic signal and situated in the liquid passage between the receiving and discharge portions, an ultrasonic receiver for receiving the ultrasonic signal transmitted from the transmitter, said receiver being situated in the liquid passage away from the transmitter between the receiving and discharge portions and connected to the control unit for operating the flow controlling means, and means for controlling the ultrasonic transmitter connected to the transmitter, said transmitter controlling means, when actuated, operating the transmitter to transmit the ultrasonic signal so that the signal from the transmitter passes through liquid filled in the liquid passage and arrives at the receiver to thereby actuate the control unit to control the flow controlling means.

2. A faucet apparatus according to claim 1, wherein said flow controlling means is a valve situated in the liquid passage to open and close the liquid passage based on the signal transmitted from the transmitter.

3. A faucet apparatus according to claim 1, further comprising a mixing valve having a manual control lever, said mixing valve being installed in the liquid passage at an upstream side of the flow controlling means.

4. A faucet apparatus according to claim 1, further comprising a shower head attached to the liquid passage discharge portion, said transmitter being installed in the shower head.

5. A faucet apparatus according to claim 4, further comprising a mixing valve having a manual control lever, said mixing valve being installed in the liquid passage at an upstream side of the flow controlling means.

6. A faucet apparatus according to claim 5, wherein said liquid passage includes a hose connected to the shower head and a guide pipe disposed outside the hose, said hose being freely movable relative to the guide pipe.

7. A faucet apparatus according to claim 6, wherein said guide pipe is arranged separately from the mixing valve.

8. A faucet apparatus comprising:

a water passage having a receiving portion for receiving water and a discharge portion for discharging water, said water passage being filled with water at least between the receiving portion and the discharge portion, a shower head attached to the water passage at the discharge portion, a valve for controlling flow of water passing through the water passage, said valve being installed in the water passage, a control unit for operating the valve, an ultrasonic transmitter for transmitting an ultrasonic signal and situated inside the shower head, an ultrasonic receiver for receiving the ultrasonic signal transmitted from the transmitter, said receiver being situated in the water passage away from the transmitter near the receiving portion and connected to the control unit for operating the valve, and means for controlling the ultrasonic transmitter attached to the shower head and electrically connected to the transmitter, said transmitter controlling means, when actuated, operating the transmitter to transmit the ultrasonic signal so that the signal from the transmitter passes through water filled in the water passage and arrives at the receiver to thereby actuate the control unit to control the valve.

* * * * *